US011259390B2

(12) United States Patent
Kamp et al.

(10) Patent No.: US 11,259,390 B2
(45) Date of Patent: Feb. 22, 2022

(54) RENDERING A DYNAMIC LIGHT SCENE BASED ON ONE OR MORE LIGHT SETTINGS

(71) Applicant: SIGNIFY HOLDING B.V., Eindhoven (NL)

(72) Inventors: Antonie Leonardus Johannes Kamp, San Francisco, CA (US); Bartel Marinus Van De Sluis, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/976,188

(22) PCT Filed: Feb. 20, 2019

(86) PCT No.: PCT/EP2019/054207
§ 371 (c)(1),
(2) Date: Aug. 27, 2020

(87) PCT Pub. No.: WO2019/166297
PCT Pub. Date: Sep. 6, 2019

(65) Prior Publication Data

US 2021/0243870 A1 Aug. 5, 2021

(30) Foreign Application Priority Data

Feb. 27, 2018 (EP) ..... 18158854

(51) Int. Cl.
*H05B 47/155* (2020.01)

(52) U.S. Cl.
CPC ..... *H05B 47/155* (2020.01)

(58) Field of Classification Search
None
See application file for complete search history.

(56) References Cited

U.S. PATENT DOCUMENTS

| | | | | |
|---|---|---|---|---|
| 2001/0030686 | A1* | 10/2001 | Young, Jr. | H04N 1/4076 348/96 |
| 2013/0293113 | A1* | 11/2013 | Morrow | H05B 47/175 315/149 |
| 2015/0161137 | A1 | 6/2015 | Lashina et al. | |
| 2016/0088707 | A1* | 3/2016 | Van De Sluis | G06F 1/1694 315/149 |
| 2016/0174342 | A1 | 6/2016 | Liu et al. | |
| 2019/0178711 | A1* | 6/2019 | Rajagopalan | H05B 47/175 |
| 2019/0394855 | A1 | 12/2019 | Meerbeek et al. | |

FOREIGN PATENT DOCUMENTS

| | | | |
|---|---|---|---|
| EP | 3226660 | B1 | 10/2018 |
| WO | 2007113740 | A1 | 10/2007 |
| WO | 2013102854 | A1 | 7/2013 |
| WO | 2016019005 | A1 | 2/2016 |
| WO | 2016083136 | A1 | 6/2016 |
| WO | 2017021088 | A1 | 2/2017 |
| WO | 2018028973 | A1 | 2/2018 |

* cited by examiner

*Primary Examiner* — Crystal L Hammond

(57) ABSTRACT

An electronic device is configured to identify a dynamic light scene (81) to be rendered, determine one or more current, previous and/or planned light settings (91, 92) for one or more lights (22, 23), determine a target dynamic light scene (83) based on said identified dynamic light scene and said one or more light settings, and render said target dynamic light scene on at least one light (22, 23).

15 Claims, 6 Drawing Sheets

RENDERING A DYNAMIC LIGHT SCENE BASED ON ONE OR MORE LIGHT SETTINGS

CROSS-REFERENCE TO PRIOR APPLICATIONS

This application is the U.S. National Phase application under 35 U.S.C. § 371 of International Application No. PCT/EP2019/054207, filed on Feb. 20, 2019, which claims the benefit of European Patent Application No. 18158854.2, filed on Feb. 27, 2018. These applications are hereby incorporated by reference herein.

FIELD OF THE INVENTION

The invention further relates to a method of rendering a dynamic light scene.

The invention relates to an electronic device for rendering a dynamic light scene.

The invention also relates to a computer program product enabling a computer system to perform such a method.

BACKGROUND OF THE INVENTION

An application called Hue Sync offered by Philips Lighting enables a PC to render a dynamic light scene based on the images displayed on a display of the PC using lights that are part of the Philips Hue system. These dynamic light scenes are rendered in real-time, but not all dynamic light scenes need to be rendered in real-time. For example, dynamic light scenes may be rendered based on pre-defined light scripts, e.g. a light script labelled "sunrise".

Solutions exist where a user can simply input his preferences with regard to dynamic light rendering, such as a "dynamics slider" in an app that enables the user to tune dynamics from mild to vivid or select a "mode" such as 'party' mode or 'chillout' mode. A drawback of this approach is that the user first needs to find those configuration options in the app, which is cumbersome. A user would prefer to quickly start the dynamic light scene and focus on the experience without having to dive into the configuration. Finding configuration options is even less desirable if the dynamic light scene starts automatically together with entertainment content.

SUMMARY OF THE INVENTION

It is a first object of the invention to provide a method, which renders a dynamic light scene according to a user's preferences without requiring the user to configure preferences for dynamic light scene rendering.

It is a second object of the invention to provide an electronic device, which is able to render a dynamic light scene according to a user's preferences without requiring the user to configure preferences for dynamic light scene rendering.

In a first aspect of the invention, the electronic device comprises at least one processor configured to identify a dynamic light scene to be rendered, determine one or more current, previous and/or planned light settings for one or more lights, determine a target dynamic light scene based on said identified dynamic light scene and said one or more light settings, and render said target dynamic light scene on at least one light. Thus, the target dynamic light scene is more like the one or more light settings than the identified dynamic light scene. Identifying the light scene may comprise receiving the light scene itself or receiving an identifier that allows the light scene to be retrieved, for example. A light is typically a light source, light node or lighting device which can be addressed and controlled individually. A scene is typically a set of light settings for a plurality of individually controllable lights.

The inventors have recognized that current, previous and planned light settings provide an indication of a user's preferences for rendering dynamic light scenes and that by taking into account these current, previous and planned light settings when rendering a dynamic light scene, it is in many cases not necessary for the user to configure his preferences for dynamic light scene rendering.

Said one or more light settings may comprise at least one of: light level (i.e. intensity), color, light distribution, beam width, number of active lights, and number of individual light beams and/or may identify at least one of: light scene which set or will set said light level and/or said color, routine which activated or will activate said light scene, and source from which said light level and/or said color have been derived, for example. For instance, the light settings may be intensity or color and the target dynamic light scene may have an (average) intensity or color palette which is closer to the light settings than the identified dynamic light scene has.

Said one or more lights may comprise said at least one light and/or comprise at least one further light located in proximity of said at least one light. This is beneficial, because light settings are often location dependent, e.g. depend on the ambient light level and/or the colors of nearby walls, carpets and/or furniture.

Said at least one processor may be configured to obtain said identified dynamic light scene and determine said target dynamic light scene by adjusting said obtained dynamic light scene based on said one or more light settings. By having the at least one processor adjust the obtained dynamic light scene, an author of a scripted dynamic light scene does not need to spend effort on authoring a group/plurality of dynamic light scenes. Adjusting the obtained dynamic light scene also works well for dynamic light scenes determined in real-time, e.g. based on entertainment content.

Said at least one processor may be configured to determine said target dynamic light scene by selecting a dynamic light scene from a group of dynamic light scenes based on said identified dynamic light scene and said one or more light settings. This allows an author of a scripted dynamic light scene to keep control of how his scripted dynamic light scene is rendered (at the cost of having to spend more effort). For example, he may author a group of three dynamic light scenes: one in which red is the dominant color, one in which green is the dominant color and one in which blue is the dominant color. In this case, obtaining the identified light scene is not required.

Said at least one processor may be configured to determine said target dynamic light scene based on how recent said one or more lights were set to said current or previous light setting. The more recent the one or more lights were set to the current or previous light setting, the more likely the current or previous light setting reflects the user's current preferences. For example, the strength of an adjustment to the obtained dynamic light scene may be based on how recent the one or more lights were set to the current or previous light setting.

Said at least one processor may be configured to determine a light level for said target dynamic light scene based on one or more current, previous and/or planned light levels for said one or more lights. A light level setting is expected to be a good indicator of a preferred light level for a dynamic light scene.

Said at least one processor may be configured to determine which colors will be dominant in said target dynamic light scene based on one or more current, previous and/or planned dominant colors and/or one or more current, previous and/or planned light levels for said one or more lights. Dominant colors and light levels are expected to be good indicators of preferred dominant colors for a dynamic light scene.

Said at least one processor may be configured to increase the intensity at which said one or more current, previous and/or planned dominant colors will be rendered as part of said target dynamic light scene compared to said identified dynamic light scene and/or increase the time period in which said one or more current, previous and/or planned dominant colors will be rendered as part of said target dynamic light scene compared to said identified dynamic light scene. By increasing the intensity and/or time period at/in which certain colors (the colors that are dominant in one or more light settings) are to be rendered, these colors become more dominant in the target dynamic scene.

Said at least one processor may be configured to determine a color palette to be used in said target dynamic light scene based on one or more current, previous and/or planned colors and/or one or more current, previous and/or planned light levels for said one or more lights. Color and light level settings are expected to be good indicators of a preferred color palette for a dynamic light scene.

Said at least one processor may be configured to determine a dynamic vividness for said target dynamic light scene based on a static vividness derived from said one or more light settings. A derived static vividness is expected to be a good indicator of a preferred dynamic vividness for a dynamic light scene.

Said at least one processor may be configured to determine a mood from said one or more light settings and/or from source data from which said one or more light settings have been derived and to determine said target dynamic light scene based on said determined mood. For example, if a light setting has been created based on an image (i.e. derived from the image data), this image may be analyzed and a mood may be selected from a plurality of predefined moods based on this analysis. Each of these predefined moods may be associated with an adjustment to an obtained identified dynamic light scene. Mood (e.g. happy or sad) is expected to be a good indicator of preferred colors or transitions for a dynamic light scene.

Said at least one light may comprise a plurality of lights and said at least one processor may be configured to map roles defined in said target dynamic light scene to said plurality of lights based on said determined light settings. If the multiple lights are to have different roles, multiple mappings are often possible. As an example of multiple lights having different roles, certain lights may be given the role of reacting to prominent sounds/beats in entertainment content, whereas other lights may be given the role of rendering functional white light. By performing the mapping automatically based on the determined light settings, a user does not need to map roles to lights manually.

In a second aspect of the invention, the method of rendering a dynamic light scene comprises identifying a dynamic light scene to be rendered, determining one or more current, previous and/or planned light settings for one or more lights, determining a target dynamic light scene based on said identified dynamic light scene and said one or more light settings, and rendering said target dynamic light scene on at least one light. The method may be implemented in hardware and/or software.

Moreover, a computer program for carrying out the methods described herein, as well as a non-transitory computer readable storage-medium storing the computer program are provided. A computer program may, for example, be downloaded by or uploaded to an existing device or be stored upon manufacturing of these systems.

A non-transitory computer-readable storage medium stores at least one software code portion, the software code portion, when executed or processed by a computer, being configured to perform executable operations comprising: identifying a dynamic light scene to be rendered, determining one or more current, previous and/or planned light settings for one or more lights, determining a target dynamic light scene based on said identified dynamic light scene and said one or more light settings, and rendering said target dynamic light scene on at least one light.

As will be appreciated by one skilled in the art, aspects of the present invention may be embodied as a device, a method or a computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit", "module" or "system." Functions described in this disclosure may be implemented as an algorithm executed by a processor/microprocessor of a computer. Furthermore, aspects of the present invention may take the form of a computer program product embodied in one or more computer readable medium(s) having computer readable program code embodied, e.g., stored, thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples of a computer readable storage medium may include, but are not limited to, the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of the present invention, a computer readable storage medium may be any tangible medium that can contain, or store, a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber, cable, RF, etc., or any suitable combination of the foregoing. Computer program code for carrying out operations for aspects of the present invention may be written in any combination of one or more programming languages, including an object-oriented programming language such as Java™, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems), and computer program products according to embodiments of the present invention. It will be understood that each block of the flowchart illustrations and/or block diagrams, and combinations of blocks in the flowchart illustrations and/or block diagrams, can be implemented by computer program instructions. These computer program instructions may be provided to a processor, in particular a microprocessor or a central processing unit (CPU), of a general purpose computer, special purpose computer, or other programmable data processing apparatus to produce a machine, such that the instructions, which execute via the processor of the computer, other programmable data processing apparatus, or other devices create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of devices, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

BRIEF DESCRIPTION OF THE DRAWINGS

These and other aspects of the invention are apparent from and will be further elucidated, by way of example, with reference to the drawings, in which.

Corresponding elements in the drawings are denoted by the same reference numeral.

DETAILED DESCRIPTION OF THE EMBODIMENTS

Figure 1:
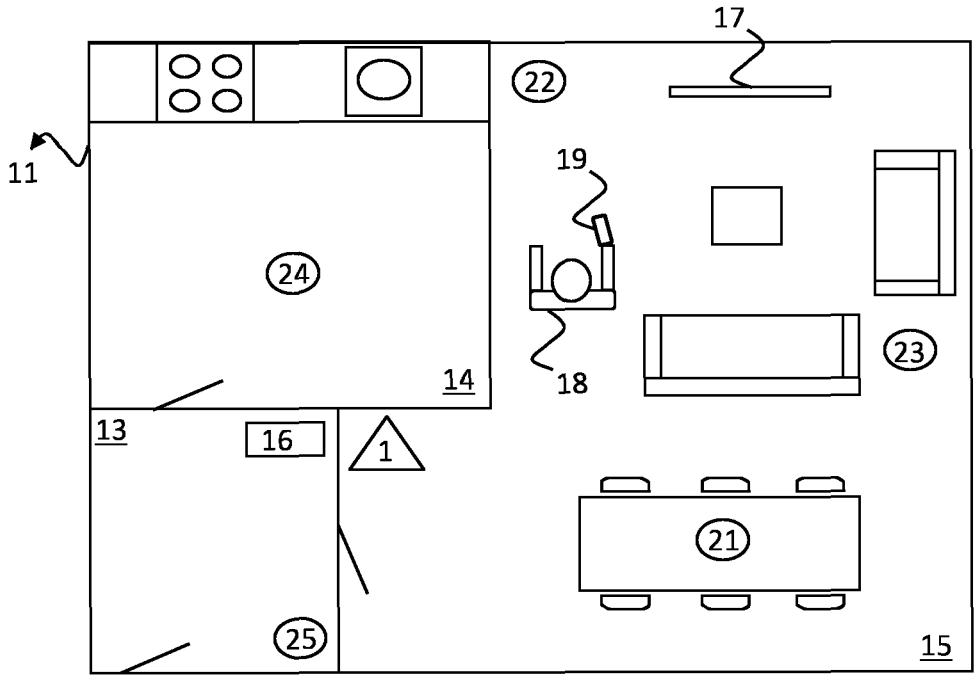
FIG. 1 depicts an example of an environment in which a first embodiment of the electronic device may be used.

FIG. 1 depicts a floor 11 of a home that consist of a hall 13, a kitchen 14 and a living room 15. Five lights have been installed on floor 11: a light 24 in the kitchen 14, a light 25 in the hall 13, and lights 21-23 in the living room 15. Light 21 has been installed above a dinner table, light 22 has been installed next to a Television 17, and light 23 has been installed next to two couches. The lights 21-25 are connected wirelessly to a bridge 1, e.g. via ZigBee or a protocol based on ZigBee. The bridge 1 is connected to a wireless access point 16, via a wire or wireless.

In the example depicted in FIG. 1, a person 18 is present on floor 11 and is using a mobile phone 19. The person 18 is also referred to as user 18. The mobile phone 19 is also connected (wirelessly) to the wireless access point 16. The mobile phone 19 may further be connected to a base station of a cellular communication network, e.g. an eNodeB of an LTE network. The user 18 may use an app on mobile phone 19 to assign lights to rooms, to manually control the lights and/or to add, change and delete (e.g. time-based) routines.

Figure 2:
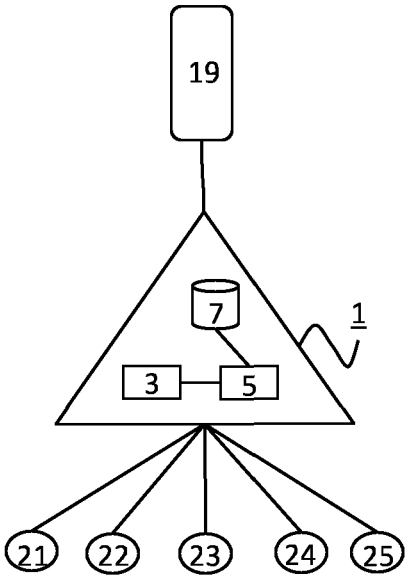
FIG. 2 is a block diagram of the first embodiment of FIG. 1.

In the example depicted in FIG. 1, the invention is implemented in bridge 1. A block diagram of bridge 1 is shown in FIG. 2. The bridge 1 comprises a processor 5, a transceiver 3 and storage means 7. The processor 5 is configured to identify a dynamic light scene to be rendered and determine one or more current, previous and/or planned light settings for one or more lights, e.g. for lights 22 and 23 or for light 21 (which is located in proximity of lights 22 and 23). The processor 5 is further configured to determine a target dynamic light scene based on the identified dynamic light scene and the one or more light settings and render the target dynamic light scene on at least one light (e.g. lights 22 and 23).

When the bridge 1 receives a command to activate a pre-defined dynamic light scene, it first identifies the dynamic light scene based on (information in) the command. The command may comprise an identifier of the dynamic light scene or a light script, for example. The command may be transmitted by the mobile device 19, for example. The user 18 may be able to start a dynamic light scene by interacting with an app on mobile device 19 using a touch screen. Alternatively, the user 18 may be able to start a dynamic light scene using voice commands, e.g. on mobile device 19, on a smart speaker like Amazon Echo or Google Home, or on bridge 1 directly.

Alternatively, the bridge 1 may receive one or more light commands that form a dynamic light scene. In this case, identifying the light scene may simply consist of receiving the one or more light commands. For example, multiple light commands may be transmitted to bridge 1 after starting playback of content (e.g. a movie or music track) that has a dynamic light scene associated with it, e.g. on mobile device 19 or on Television 17.

Typically, a user will have predefined 'entertainment setups' which are basically user selected groups of lights on which a dynamic light scene will be rendered (e.g. a group with lights 22 and 23). Typically, this will be a superset or subset of room or zone groups, which a user has configured for his static light scenes and routines. The bridge 1 can relate those to each other and thereby determine the (current, previous and/or planned) light settings for those lights. This includes the state of the lights (on, brightness, color temperature, color) as well as the 'metadata' e.g. whether it is connected to an activity ('dinner' scene vs 'wake-up' routine), what picture, video or color palette it is derived from or how it is triggered. Typically, there is always a current light setting to determine and sometimes there is also an upcoming light setting which is relevant if it is planned in the nearby future.

An identified dynamic light scene behaves in a certain way based on a multitude of parameters such as color palette, brightness (average and dynamic range), saturation (average and dynamic range), dynamicity, transitions (from slow to instant), effect type and frequency of effect type change, different light roles and so forth. In the target dynamic light scene determined by the bridge 1, this behavior will normally be different than in the identified dynamic light scene. For example, the target dynamic light scene may be obtained by adjusting the parameters of the identified dynamic light scene based on directly or indirectly related parameters of the determined one or more light settings.

Some parameters can be adjusted based on the one or more settings directly, such as the color palette or average brightness. But others would have an indirect adjustment based on matching the known or intended effect the light settings and dynamic scene parameters have on the human physiological state and perception. For example, a warm color temperature light scene or an upcoming go to bed routine have the known or intended effect on people of winding down. This may be translated to the dynamic effect of slow transitions and a low dynamic brightness range of the dynamic scene. Another example is a very bright scene or a specific workout activity scene, which have the known or intended effect on people of energizing them. This may be translated to the dynamic effect of high dynamism and snappy transitions.

In the embodiment of FIG. 2, the processor 5 is configured to obtain the identified dynamic light scene and determine the target dynamic light scene by adjusting the obtained dynamic light scene based on the one or more light settings. In an alternative embodiment, the processor 5 is configured to determine the target dynamic light scene by selecting a dynamic light scene from a group of dynamic light scenes based on the identified dynamic light scene and the one or more light settings. In other words, instead of adjusting parameters of a dynamic light scene in real-time, multiple predefined variants of a dynamic light scenes (e.g. a low, medium and high dynamic one) may be defined and the best matching one may be chosen based on the determined light settings.

The bridge 1 may render the target dynamic light scene on the at least one light by calculating with a certain frame rate the light output from the identified dynamic light scene, creating that that light color (e.g. by mixing different color LEDs with the correct Pulse Width Modulation values) and transmitting one or more light commands to the at least one light. If the at least one light comprises multiple lights, this calculation may be performed for each light separately.

In the embodiment of the bridge 1 shown in FIG. 2, the bridge 1 comprises one processor 5. In an alternative embodiment, the bridge 1 comprises multiple processors. The processor 5 of the bridge 1 may be a general-purpose processor, e.g. from ARM, Intel or AMD or an application-specific processor. The processor 5 of the bridge 1 may run a Unix-based operating system for example. The transceiver 3 may use one or more wired and/or one or more wireless communication technologies to communicate with the lights 21-25 and the wireless internet access point 16, e.g. Ethernet, Wi-Fi, ZigBee (or a protocol based on ZigBee) and/or Bluetooth. The bridge 1 may use the transceiver 3 to communicate with the mobile phone 19 and/or with devices on the Internet via the wireless internet access point 16.

In an alternative embodiment, multiple transceivers are used instead of a single transceiver, e.g. one for ZigBee and one for Wi-Fi. In the embodiment shown in FIG. 2, a receiver and a transmitter have been combined into a transceiver 3. In an alternative embodiment, one or more separate receiver components and one or more separate transmitter components are used. The storage means 7 may comprise one or more memory units. The storage means 7 may comprise solid state memory, for example. The storage means 7 may be used to store information on connected devices (e.g. lights and accessory devices) and configuration information (e.g. in which rooms connected devices are located, routines and/or associations between buttons and light scenes), for example. The bridge 1 may comprise other components typical for a bridge such a power connector. The invention may be implemented using a computer program running on one or more processors.

Figure 3:
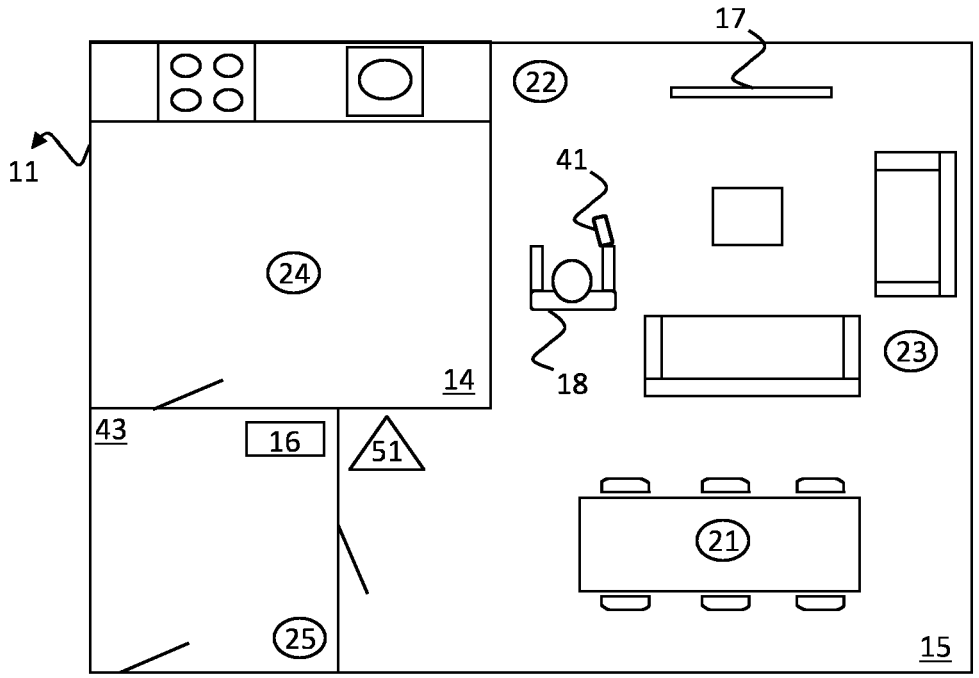
FIG. 3 depicts an example of an environment in which a second embodiment of the electronic device may be used.

The example depicted in FIG. 3 is similar to the example depicted in FIG. 1, but in the example depicted in FIG. 3, the invention is implemented in mobile device 41. The mobile device 41 may be a mobile phone or tablet, for example. In this example, a conventional bridge 51 is used. A block diagram of mobile device 41 is shown in FIG. 2. The mobile device 41 comprises a processor 45, a transceiver 43, storage means 47 and a display 49. The processor 45 is configured to identify a dynamic light scene to be rendered and determine one or more current, previous and/or planned light settings for one or more lights, e.g. for lights 22 and 23 or for light 21 (which is located in proximity of lights 22 and 23). The processor 45 is further configured to determine a target dynamic light scene based on the identified dynamic light scene and the one or more light settings and render the target dynamic light scene on at least one light (e.g. lights 22 and 23).

Figure 4:
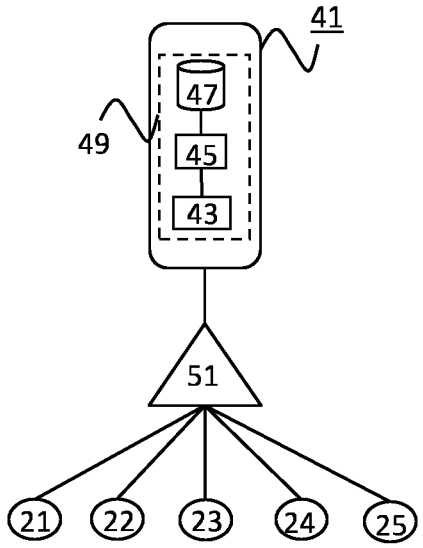
FIG. 4 is a block diagram of the second embodiment of FIG. 3.

In the embodiment of the mobile device 41 shown in FIG. 4, the mobile device 41 implements the invention in a similar manner as described above in relation to bridge 1 of FIG. 2. However, the mobile device 41 communicates with bridge 51 in order to obtain the one or more settings of the one or more lights and to render the target dynamic light scene on the at least one light. The invention may be implemented in an app that receives commands from another (e.g. media renderer) app on mobile device 41 or from Television 17, for example.

In the embodiment of the mobile device 41 shown in FIG. 4, the mobile device 41 comprises one processor 45. In an alternative embodiment, the mobile device 41 comprises multiple processors. The processor 45 of the mobile device 41 may be a general-purpose processor, e.g. from ARM or Qualcomm or an application-specific processor. The processor 45 of the mobile device 41 may run a Google Android or Apple iOS operating system for example. The transceiver 43 may use one or more wireless communication technologies to communicate with the wireless internet access point 16, e.g. Wi-Fi and/or Bluetooth. The mobile device 41 may use the transceiver 43 to communicate with the bridge 51 and/or with devices on the Internet via the wireless internet access point 16. In an alternative embodiment, multiple transceivers are used instead of a single transceiver, e.g. one for Bluetooth and one for Wi-Fi.

In the embodiment shown in FIG. 4, a receiver and a transmitter have been combined into a transceiver 43. In an alternative embodiment, one or more separate receiver components and one or more separate transmitter components are used. The storage means 47 may comprise one or more memory units. The storage means 47 may comprise solid state memory, for example. The storage means 47 may be used to store an operating system, apps and data, for example. The display 49 may comprise an LCD or OLED display panel, for example. The display 49 may be a touch screen. The mobile device 41 may comprise other components typical for a mobile device such a battery. The invention may be implemented using a computer program running on one or more processors.

In the embodiment of FIG. 2, the invention is implemented in a bridge. In the embodiment of FIG. 4, the invention is implemented in a mobile device. In an alternative embodiment, the invention may be implemented in a separate device connected to a bridge or in a light, for example. The invention may be partly or wholly implemented in a server on the Internet (e.g. a cloud server).

FIGS. 5-9 show examples of a target dynamic light scene being determined based on an identified dynamic light scene and light settings. In these examples, video rendering is started at moment 73 (19:13:33) and each second, RGB values are determined from the video by performing image analysis. These RGB values form the identified dynamic light scene 81. These RGB values may be transmitted to bridge 1 of FIG. 1 by Television 17, for example. In the examples of FIGS. 5-9, the settings of the lights 21, 22 and 23 are shown. In these examples, "off" is shown if the light is off and an RGB value is shown if the light is on. The target dynamic light scene which is used to control lights 21 and 22 is determined by adjusting the RGB values determined from the video.

In all the examples of FIGS. 5-9, the dynamic scene ends up being rendered. However, certain determined light settings could result in an adjustment that comprises not starting the dynamic light scene at all, e.g. when the currently rendered scene is a nightlight scene or an emergency scene.

Furthermore, only color light settings are shown in the examples. The lights settings may further comprise light level, light distribution, beam width, number of active lights, and number of individual light beams and/or identify at least one of: light scene which set or will set the light level and/or the color, routine which activated or will activate the light scene, and/or source from which the light level and/or the color have been derived. A light level in the target dynamic light scene may be determined based on one or more current, previous and/or planned light levels for the lights 21, 22 and/or 23, for example.

A routine may be associated with an activity type. As a first example, a "dinner" or "study" scene may result in more subtle dynamics and a "workout" or "party" scene in more lively dynamics. As a second example, when a "go to bed" routine is coming up, a warmer/dimmer dynamic light scene may be used and when 'a fresh wakeup' routine is coming up, a colder/brighter dynamic light scene may be used. The source from which the light level and/or the color have been derived may be an image or song, for example.

In all the examples of FIGS. 5-9, a target RGB value in a target dynamic light scene is determined from an identified RGB value in an identified dynamic light scene and a set RGB value in a setting by subtracting the identified RGB value from the set RGB value and adding half of the result to the identified RGB value. This results in the color palette of the identified dynamic light scene being adjusted based on the setting. Alternatively, the color palette to be used in the target dynamic light scene can be based on the current, previous and/or planned colors for the lights 21, 22 and/or 23 in a different manner and/or can be based on one or more current, previous and/or planned light levels for the lights 21, 22 and/or 23.

Alternatively, color settings could be adjusted in a different manner. As a first example, which colors will be dominant in the target dynamic light scene may be determined based on one or more current, previous and/or planned dominant colors for the lights 21, 22 and/or 23. As a second example, which colors will be dominant in the target dynamic light scene may be determined based on one or more current, previous and/or planned light levels for the lights 21, 22 and/or 23. For instance, "warmer" colors (e.g. yellow, orange) may be made dominant for low light levels and colder colors (e.g. green, blue) may be made dominant for high light levels.

These colors may be made dominant in the target dynamic light scene by increasing the intensity at which the one or more current, previous and/or planned dominant colors will be rendered as part of the target dynamic light scene compared to the identified dynamic light scene and/or by increasing the time period in which the one or more current, previous and/or planned dominant colors will be rendered as part of the target dynamic light scene compared to the identified dynamic light scene, for example.

Figure 5:
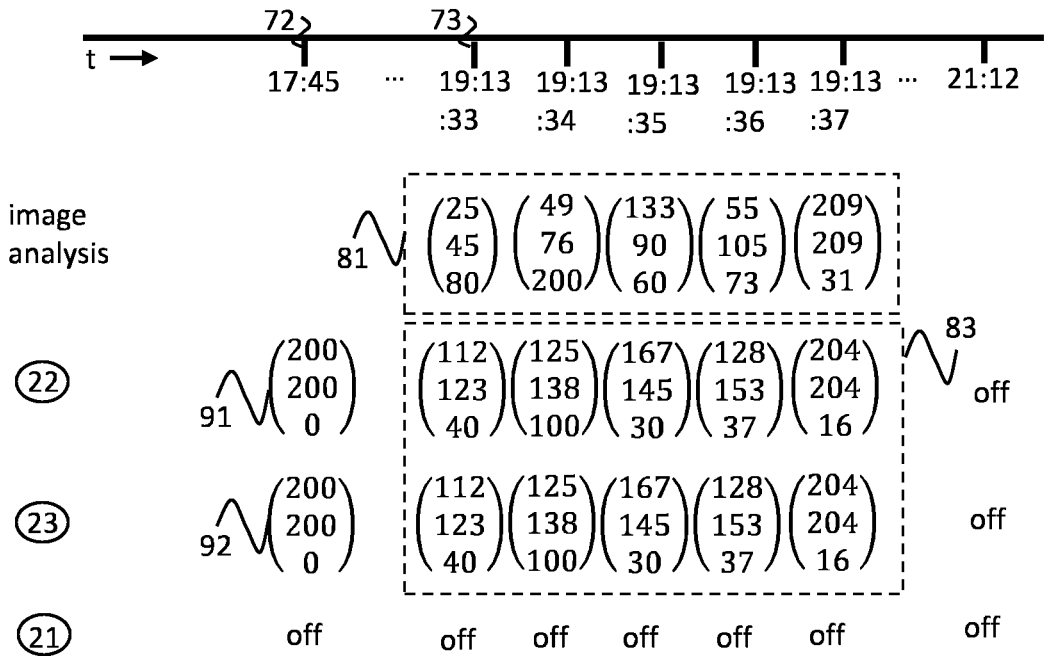
FIG. 5 shows a first example of a target dynamic light scene being determined based on an identified dynamic light scene.

In the example of FIG. 5, the target dynamic light scene 83 is obtained by adjusting the identified dynamic light scene 81 based on the current settings 91 and 92 of the lights 22 and 23, respectively. Settings 91 and 92 are set at 17:45 (moment 72) and not changed until the dynamic scene is started at 19:13:33 (moment 73). Light 21 stays off during the evening.

Figure 6:
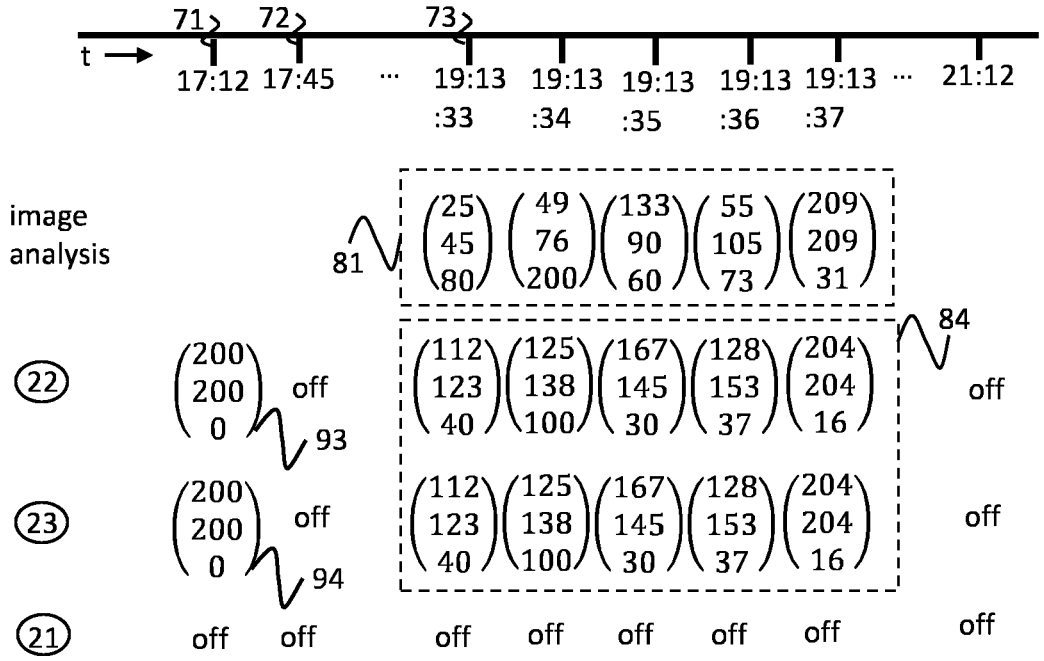
FIG. 6 shows a second example of a target dynamic light scene being determined based on an identified dynamic light scene.

In the example of FIG. 6, target dynamic light scene 84 is obtained by adjusting the identified dynamic light scene 81 based on the previous settings 93 and 94 of the lights 22 and 23, respectively. Settings 93 and 94 are set at 17:12 (moment 71), but lights 22 and 23 are switched off at 17:45 (moment 72) and not switched on until the dynamic scene is started at 19:13:33 (moment 73). Since settings 93 and 94 are the same as settings 91 and 92 of FIG. 5, the dynamic scene 84 is the same as dynamic scene 83 of FIG. 5.

Figure 7:
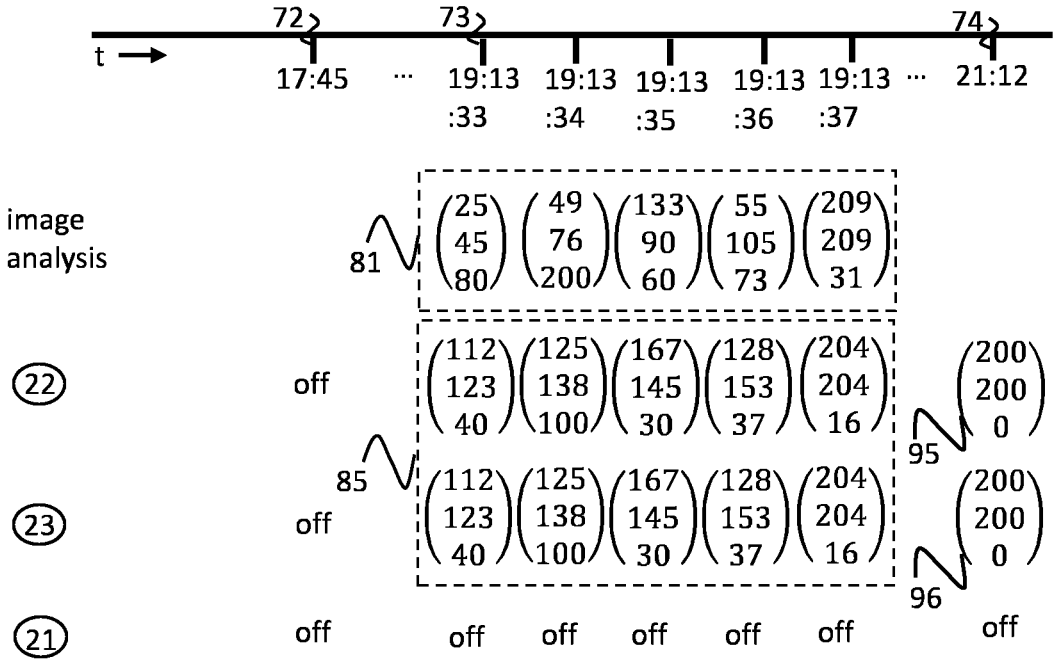
FIG. 7 shows a third example of a target dynamic light scene being determined based on an identified dynamic light scene.

In the example of FIG. 7, target dynamic light scene 85 is obtained by adjusting the identified dynamic light scene 81 based on the planned settings 95 and 96 of the lights 22 and 23, respectively. The planned settings are set by a time-based routine at 21:12 (moment 74). Since settings 95 and 96 are the same as settings 91 and 92 of FIG. 5 and settings 93 and 94 of FIG. 6, the dynamic scene 85 is the same as dynamic scenes 83 and 84 of FIG. 5 and FIG. 6.

In the examples of FIGS. 5-7, only one of current, previous and planned settings are used to adjust the identified dynamic light scene 81. In an alternative embodiment, multiple of these three classes of settings are used, e.g. if lights 22 and 23 are switched off at the moment the rendering of the dynamic light scene is started, both the previous and planned settings may be used. In the example of FIG. 7, there are no recent previous settings for lights 22 and 23.

Figure 8:
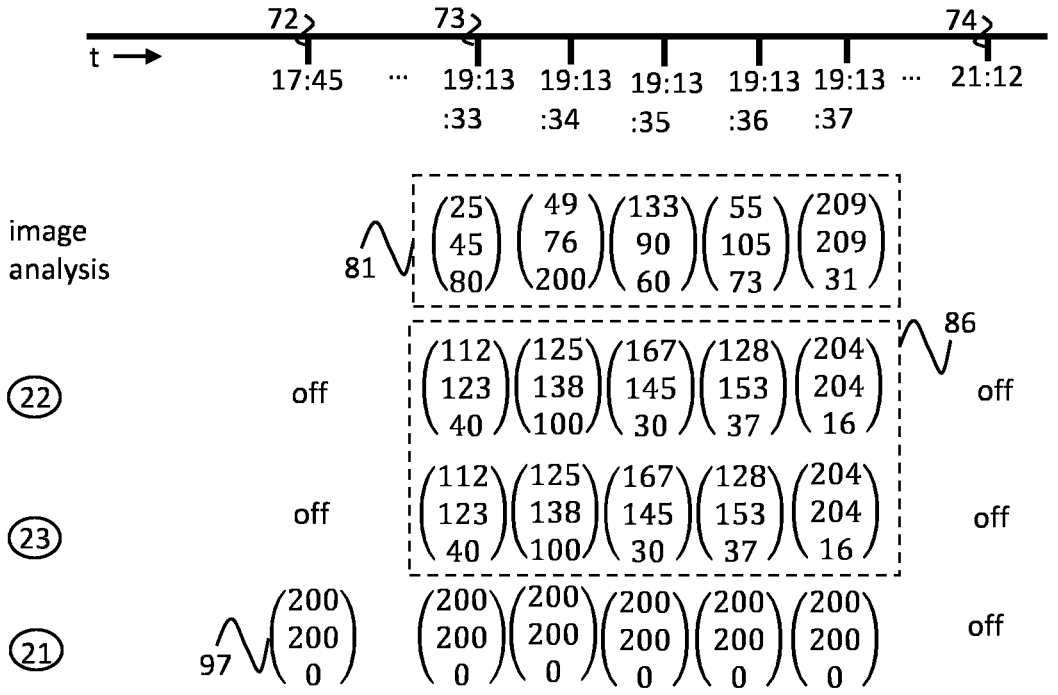
FIG. 8 shows a fourth example of a target dynamic light scene being determined based on an identified dynamic light scene.

In the example of FIG. 8, target dynamic light scene 86 is obtained by adjusting the identified dynamic light scene 81 based on the current settings 97 of further light 21. Light 21 is in proximity of lights 22 and 23. Light 21 may have been determined to be in proximity of lights 22 and 23 by using position detection, for example. Settings 97 are set at 17:45 (moment 72) and not changed until the light 21 is switched off, e.g. by a time-based routine, at 21:12 (moment 74).

Figure 9:
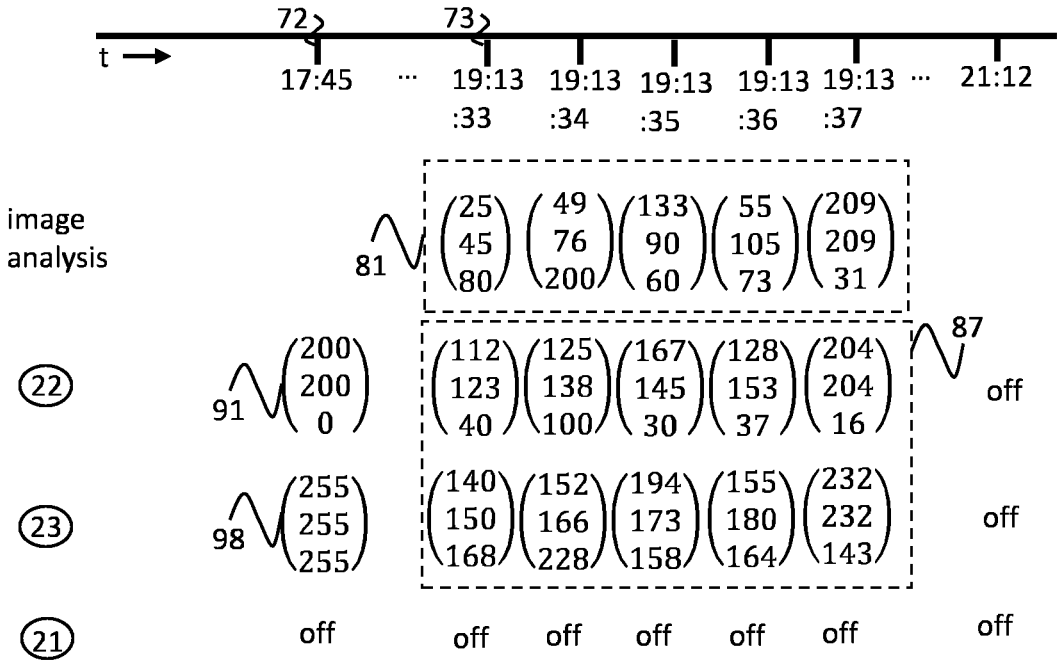
FIG. 9 shows a fifth example of a target dynamic light scene being determined based on an identified dynamic light scene.

In the examples of FIGS. 5-7, the used settings of lights 21 and 22 are the same. FIG. 9 shows an example in which the used settings of lights 21 and 22 are not the same. The target dynamic light scene 87 is obtained by adjusting the identified dynamic light scene 81 based on the current settings 91 and 98 of the lights 22 and 23, respectively. Settings 91 and 98 are set at 17:45 (moment 72) and not changed until the dynamic scene is started at 19:13:33 (moment 73). Since the settings 91 and 98 are different, the dynamic light scene is rendered differently on light 23 than on light 22.

The bridge 1 and the mobile device 41 may be enhanced by configuring their processor (processors 5 and 45, respectively) as follows:

Configure the processor to determine the target dynamic light scene, e.g. the strength of the adjustment of the identified dynamic light scene, based on how recent the one or more lights were set to the current or previous light setting (and optionally based on how soon the next light setting is scheduled).

Configure the processor to determine a dynamic vividness (e.g. dynamic range, transition speed, effect type) for the target dynamic light scene based on a static vividness (brightness, color temperature, color differences between lights) derived from the one or more light settings.

Configure the processor to map roles defined in the target dynamic light scene to a plurality of lights (if the dynamic light scene is to be rendered on a plurality of lights) based on the determined light settings. For example, if one lamp is set to a high intensity, this lamp may play the dynamic (or prominent) effect in the dynamic scene.

Configure the processor to determine a mood from the one or more light settings and/or from source data from which the one or more light settings have been derived and to determine the target dynamic light scene based on the determined mood. Mood is not a light setting by itself, but refers to the human emotional perception of a (dynamic) light setting, image/video or piece of music. Using this human perception, images, music and light settings that 'fit together' from an emotional point of view can be linked. For example, in music certain notes and rhythms are perceived as sad whereas some other notes and rhythms are perceived as happy. Similar in dynamic lighting, certain colors and transitions are perceived as happy and others as sad (or other emotions). This also applies to images and movies. The mood can be derived from the static light setting and then used as input for the dynamic light setting. A static light setting has less mood information than a dynamic one, but additional info on the intended mood of the static setting can be obtained by analyzing the mood of the original image the light setting was created from. This original image may be identified in the light settings.

Figure 10:
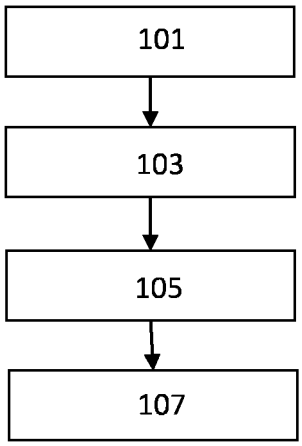
FIG. 10 is a flow diagram of an embodiment of the method of the invention.

An embodiment of the method of the invention is shown in FIG. 10. A step 101 comprises identifying a dynamic light scene to be rendered. A step 103 comprises determining one or more current, previous and/or planned light settings for one or more lights. A step 105 comprises determining a target dynamic light scene based on the identified dynamic light scene and the one or more light settings. A step 107 comprises rendering the target dynamic light scene on at least one light.

Figure 11:
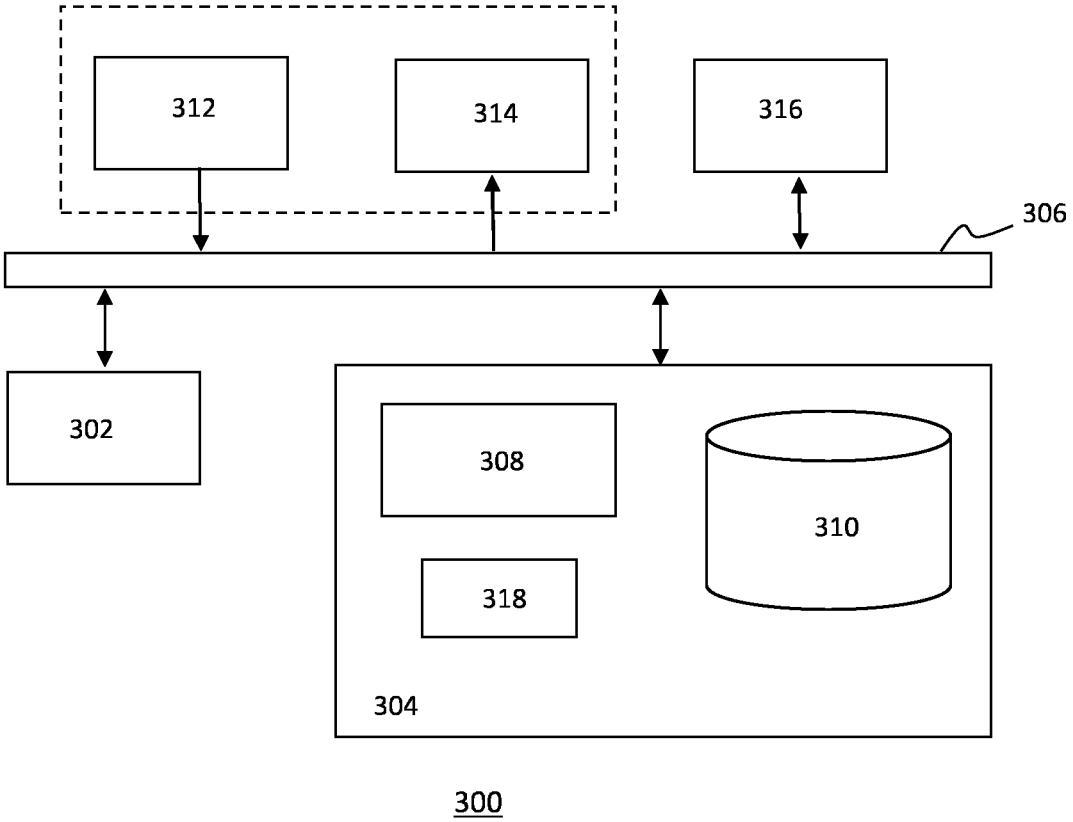
FIG. 11 is a block diagram of an exemplary data processing system for performing the method of the invention.

FIG. 11 depicts a block diagram illustrating an exemplary data processing system that may perform the method as described with reference to FIG. 10.

As shown in FIG. 11, the data processing system 300 may include at least one processor 302 coupled to memory elements 304 through a system bus 306. As such, the data processing system may store program code within memory elements 304. Further, the processor 302 may execute the program code accessed from the memory elements 304 via a system bus 306. In one aspect, the data processing system may be implemented as a computer that is suitable for storing and/or executing program code. It should be appreciated, however, that the data processing system 300 may be implemented in the form of any system including a processor and a memory that is capable of performing the functions described within this specification.

The memory elements 304 may include one or more physical memory devices such as, for example, local memory 308 and one or more bulk storage devices 310. The local memory may refer to random access memory or other non-persistent memory device(s) generally used during actual execution of the program code. A bulk storage device may be implemented as a hard drive or other persistent data storage device. The processing system 300 may also include one or more cache memories (not shown) that provide temporary storage of at least some program code in order to reduce the quantity of times program code must be retrieved from the bulk storage device 310 during execution.

Input/output (I/O) devices depicted as an input device 312 and an output device 314 optionally can be coupled to the data processing system. Examples of input devices may include, but are not limited to, a keyboard, a pointing device such as a mouse, or the like. Examples of output devices may include, but are not limited to, a monitor or a display, speakers, or the like. Input and/or output devices may be coupled to the data processing system either directly or through intervening I/O controllers.

In an embodiment, the input and the output devices may be implemented as a combined input/output device (illustrated in FIG. 11 with a dashed line surrounding the input device 312 and the output device 314). An example of such a combined device is a touch sensitive display, also sometimes referred to as a "touch screen display" or simply "touch screen". In such an embodiment, input to the device may be provided by a movement of a physical object, such as e.g. a stylus or a finger of a user, on or near the touch screen display.

A network adapter 316 may also be coupled to the data processing system to enable it to become coupled to other systems, computer systems, remote network devices, and/or remote storage devices through intervening private or public networks. The network adapter may comprise a data receiver for receiving data that is transmitted by said systems, devices and/or networks to the data processing system 300, and a data transmitter for transmitting data from the data processing system 300 to said systems, devices and/or networks. Modems, cable modems, and Ethernet cards are examples of different types of network adapter that may be used with the data processing system 300.

As pictured in FIG. 11, the memory elements 304 may store an application 318. In various embodiments, the application 318 may be stored in the local memory 308, the one or more bulk storage devices 310, or separate from the local memory and the bulk storage devices. It should be appreciated that the data processing system 300 may further execute an operating system (not shown in FIG. 11) that can facilitate execution of the application 318. The application 318, being implemented in the form of executable program code, can be executed by the data processing system 300, e.g., by the processor 302. Responsive to executing the application, the data processing system 300 may be configured to perform one or more operations or method steps described herein.

Various embodiments of the invention may be implemented as a program product for use with a computer system, where the program(s) of the program product define functions of the embodiments (including the methods described herein). In one embodiment, the program(s) can be contained on a variety of non-transitory computer-readable storage media, where, as used herein, the expression "non-transitory computer readable storage media" comprises all computer-readable media, with the sole exception being a transitory, propagating signal. In another embodiment, the program(s) can be contained on a variety of transitory computer-readable storage media. Illustrative computer-readable storage media include, but are not limited to: (i) non-writable storage media (e.g., read-only memory devices within a computer such as CD-ROM disks readable by a CD-ROM drive, ROM chips or any type of solid-state non-volatile semiconductor memory) on which information is permanently stored; and (ii) writable storage media (e.g., flash memory, floppy disks within a diskette drive or hard-disk drive or any type of solid-state random-access semiconductor memory) on which alterable information is stored. The computer program may be run on the processor 302 described herein.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of embodiments of the present invention has been presented for purposes of illustration, but is not intended to be exhaustive or limited to the implementations in the form disclosed. Many modifications and variations will be apparent to those of ordinary skill in the art without departing from the scope and spirit of the present invention. The embodiments were chosen and described in order to best explain the principles and some practical applications of the present invention, and to enable others of ordinary skill in the art to understand the present invention for various embodiments with various modifications as are suited to the particular use contemplated.

The invention claimed is:

1. An electronic device comprising at least one processor configured to:

identify a dynamic light scene to be rendered, wherein said dynamic light scene is composed of visibly perceptible changes of lighting characteristics over time, determine a color and/or light level of a current light scene for one or more lights, determine a target dynamic light scene by adjusting said identified dynamic light scene based on the determined color and/or light level of the current light scene, and render said target dynamic light scene on at least one light of the one or more lights.

2. An electronic device as claimed in claim 1, wherein a degree of likeness between the target dynamic light scene and the current light scene is greater than a degree of likeness between the identified dynamic light scene and the current light scene.

3. An electronic device as claimed in claim 1, wherein the current light scene is a static light scene.

4. An electronic device as claimed in claim 1, wherein said at least one processor is configured to determine said target dynamic light scene by selecting a dynamic light scene from a group of dynamic light scenes based on the determined color and/or light level of the current light scene.

5. An electronic device as claimed in claim 1, wherein said at least one processor is configured to determine said target dynamic light scene based on how recent said one or more lights were set to said current light scene.

6. An electronic device as claimed in claim 1, wherein said at least one processor is configured to determine a light level of the target dynamic light scene is based on an average, median or most frequently occurring light level of the current light scene.

7. An electronic device as claimed in claim 1, wherein said at least one processor is configured to determine a color of the target dynamic light scene based on a dominant color of the current light scene.

8. An electronic device as claimed in claim 1, wherein said at least one processor is configured to increase an intensity, compared to said identified dynamic light scene, at which a dominant color of the current light scene will be rendered as part of the target dynamic light scene.

9. An electronic device as claimed in claim 1, wherein said at least one processor is configured to increase a time period, compared to said identified dynamic light scene, in which a dominant color of the current light scene will be rendered as part of said target dynamic light scene.

10. An electronic device as claimed in claim 1, wherein said at least one processor is configured to determine a color palette to be used in said target dynamic light scene based on a color palette of the current light scene.

11. An electronic device as claimed in claim 1, wherein said at least one processor is configured to determine a dynamic vividness for said target dynamic light scene based on a static vividness derived from the determined color and/or light level of the current light scene.

12. An electronic device as claimed in claim 1, wherein said at least one processor is configured to determine a mood from the determined color and/or light level of the current light scene and/or from source data from which the current light scene has been derived and to determine said target dynamic light scene based on said determined mood.

13. An electronic device as claimed in claim 1, wherein said at least one light comprises a plurality of lights and said at least one processor is configured to map roles defined in said target dynamic light scene to said plurality of lights based on the determined color and/or light level of the current light scene.

14. A method of rendering a dynamic light scene, comprising:

identifying a dynamic light scene to be rendered, wherein said identified dynamic light scene is composed of visibly perceptible changes of lighting characteristics over time;

determining a color and/or light level of a current light scene for one or more lights;

determining a target dynamic light scene by adjusting said identified dynamic light scene based on the determined color and/or light level of the current light scene; and rendering said target dynamic light scene on at least one light of the one or more lights.

15. A non-transitory storage medium comprising a program of instructions configured to cause at least one processor to perform the method of claim 14 when said at least one processor executes the instructions.

* * * * *